United States Patent [19]

Slusher

[11] 4,010,558

[45] Mar. 8, 1977

[54] GOLF RUBBER OVERSHOE

[75] Inventor: John G. Slusher, Jackson Heights, N.Y.

[73] Assignee: The Raymond Lee Organization, Inc., New York, N.Y. ; a part interest

[22] Filed: Nov. 10, 1975

[21] Appl. No.: 630,421

[52] U.S. Cl. ..... 36/7.3; 36/105; 36/127

[51] Int. Cl.² ..... A43B 1/10; A43B 5/00; A43B 21/00

[58] Field of Search ..... 36/7.3, 106, 127, 135, 36/7.4, 105

[56] References Cited

UNITED STATES PATENTS

| | | | |
|---|---|---|---|
| 900,499 | 10/1908 | Eckhard | 36/7.4 |
| 1,811,781 | 6/1931 | Degge | 36/135 |
| 2,970,390 | 2/1961 | Brough et al. | 36/7.3 |
| 3,192,651 | 7/1965 | Smith | 36/105 |

*Primary Examiner*—Patrick D. Lawson
*Attorney, Agent, or Firm*—Howard I. Podell

[57] ABSTRACT

A golf overshoe which is fabricated of flexible rubber or plastic which fits over a pair of golf shoes, with the heel and sole portions of the overshoe formed as an open section to provide for clearance for the spikes of a golf shoe about which the overshoe is fitted. The rear section of the overshoe, fitting about the rear of a golf shoe is divided to form an overlap and strap is fastened by a snap fastener to hold the attached section in position.

1 Claim, 4 Drawing Figures

GOLF RUBBER OVERSHOE

SUMMARY OF THE INVENTION

My invention is a golf overshoe which is fabricated of flexible rubber or plastic which fits over a pair of golf shoes, with the heel and sole portions of the overshoe formed as an open section to provide for clearance for the spikes of a golf shoe about which the overshoe is fitted. The rear section of the overshoe, fitting about the rear of a golf shoe is divided to form an overlap and strap is fastened by a snap fastener to hold the attached section in position.

The overshoe is readily fastened about a golf shoe to protect the golf shoe from the effect of wet grass, with the spikes of the golf shoe projecting through the open sole and heel section of the overshoe.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 2:
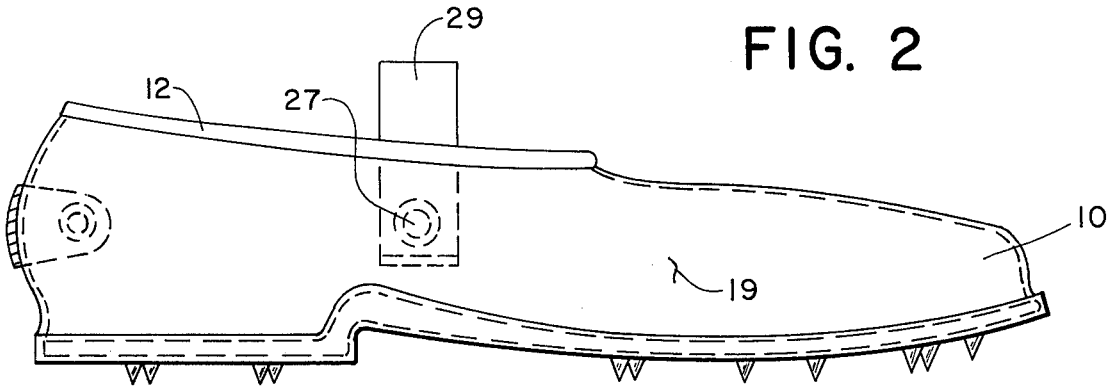
FIG. 2 is a side view of the invention installed on a golf shoe.
Figure 1:
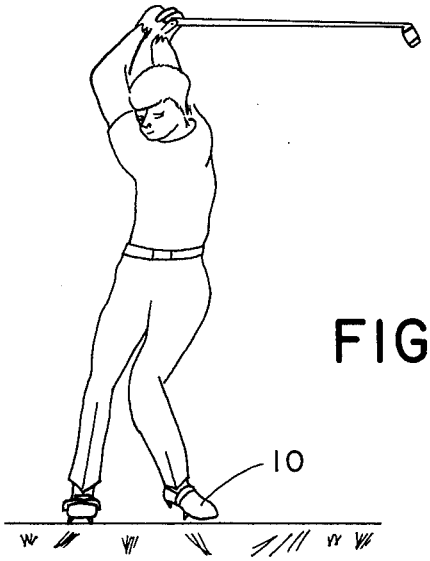
FIG. 1 is a perspective view of the invention in use.
Figure 3:
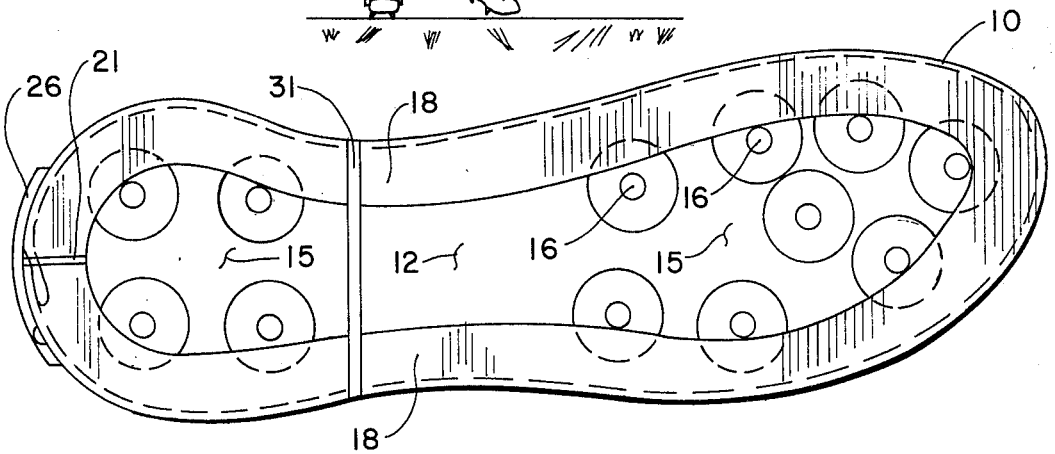
FIG. 3 is a bottom plan view of the invention installed.
Figure 4:
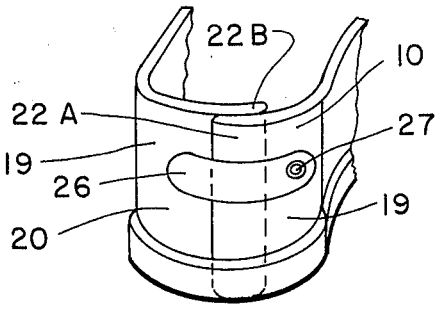
FIG. 4 is a rear end view of the invention installed on a golf shoe.

Turning now descriptively to the drawings, in which similar reference characters denote similar elements throughout the several views, FIGS. 1–4 illustrate the golf overshoe 10 fitted about a golf shoe 12 so as to protect the golf shoe 12 from moisture or wet grass.

The overshoe 10 is fabricated of a flexible rubber or plastic material.

A continuous central opening 15 is formed in the sole and heel portions of the overshoe 10 to provide clearance for the spikes 16 of a golf shoe 12, with opening 15 bounded by a border strip 18 of the overshoe that joins the sides 19 of the overshoe 10.

The overshoe 10 is formed with a divided heel section 20 with a flap 22A of one side 19 of the heel section fitting over a flap 22B attached to the other side 19 of the heel section, and with a slot 21 extending through the rear end of the border strip 18. A flexible strap 26 is fixed to one side 19 of the heel section 20 that detachably fastens to a snap fastener 27 fixed to the other side 19 of the heel section so that the overshoe may be readily slipped over a golf shoe and strapped in place about the heel of the overshoe.

A flexible strap 29 is held by snap fasteners 27 about the instep portion of the overshoe 10 when the overshoe 10 is fitted about a golf shoe 11.

A strap 31 joins the opposed sole border sections 18 of the overshoe under the instep area adjacent to the heel section.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. An overshoe of flexible rubber or plastic material for fitting about a spiked golf shoe, said overshoe shaped to fit over a golf shoe, with the sole and heel portion of the overshoe shaped with an open section to provide clearance for the spikes on the sole and heel of the golf shoe, said open section bounded by a border strip that is continuous save for a slot in the rear of the heel section, which slot marks the separation of two rear sections forming the rear side of the overshoe.

said two rear sections joined in overlapping fashion along the rear vertical sides of the overshoe by a first detachable strap, together with a second strap mounted to extend over the top of the overshoe which is detachably fastened to each opposed side of the overshoe at the instep section of the overshoe.

* * * * *